US010221850B2

(12) United States Patent
Rapp

(10) Patent No.: US 10,221,850 B2
(45) Date of Patent: Mar. 5, 2019

(54) PISTON MACHINE WITH COOLING FUNCTION

(71) Applicant: RapSon GmbH, Berlin-Steglitz (DE)

(72) Inventor: Manfred Max Rapp, Berlin (DE)

(73) Assignee: RapSon GmbH, Berlin-Steglitz (DE)

( * ) Notice: Subject to any disclaimer, the term of this patent is extended or adjusted under 35 U.S.C. 154(b) by 103 days.

(21) Appl. No.: 15/309,676

(22) PCT Filed: May 12, 2015

(86) PCT No.: PCT/EP2015/060500
§ 371 (c)(1),
(2) Date: Nov. 8, 2016

(87) PCT Pub. No.: WO2015/173255
PCT Pub. Date: Nov. 19, 2015

(65) Prior Publication Data

US 2017/0138359 A1 May 18, 2017

(30) Foreign Application Priority Data

May 12, 2014 (DE) ..... 10 2014 208 939

(51) Int. Cl.
*F04C 15/00* (2006.01)
*F01C 21/10* (2006.01)
(Continued)

(52) U.S. Cl.
CPC ..... *F04C 15/0096* (2013.01); *F01C 9/002* (2013.01); *F01C 21/06* (2013.01); *F01C 21/10* (2013.01); *F01C 21/18* (2013.01); *F04C 9/002* (2013.01); *F04C 15/06* (2013.01); *F04C 21/002* (2013.01); *F04C 29/04* (2013.01); *F04C 29/12* (2013.01); *F04C 2240/30* (2013.01)

(58) Field of Classification Search
CPC ..... F04C 15/0096; F04C 29/04; F04C 9/002; F04C 21/002
See application file for complete search history.

(56) References Cited

U.S. PATENT DOCUMENTS 1,363,423 A * 12/1920 Le Pierre ..... F02B 53/00 123/18 R
3,408,991 A * 11/1968 Davis ..... F01C 9/002 123/18 R
(Continued)

FOREIGN PATENT DOCUMENTS

DE 23 53 008 A1 4/1975
DE 37 05 313 A1 10/1987
(Continued)

OTHER PUBLICATIONS

Translation of the International Preliminary Report on Patentability issued in PCT/EP2015/060500; dated Nov. 24, 2016; 11pp.
(Continued)

*Primary Examiner* — Thomas E Lazo
(74) *Attorney, Agent, or Firm* — Studebaker & Brackett PC

(57) ABSTRACT

The invention relates to a piston machine which comprises: a housing with a chamber with has a substantially circle sector-shaped cross-section; a pivotal piston which is designed as a pivoting element, is arranged in the housing and comprises a first working surface, wherein the housing and the piston define at least one first variable working chamber; a drive or output which is connected to the piston; and an outlet which is arranged in the working chamber for discharging a working fluid. The housing has a cooling opening in at least one housing wall, said opening leading to the chamber at least for convectively cooling a piston side opposite the first working surface by means of a coolant.

18 Claims, 15 Drawing Sheets

(51) Int. Cl.

| | |
|---|---|
| ***F04C 9/00*** | (2006.01) |
| ***F04C 15/06*** | (2006.01) |
| ***F01C 9/00*** | (2006.01) |
| ***F01C 21/06*** | (2006.01) |
| ***F01C 21/18*** | (2006.01) |
| ***F04C 21/00*** | (2006.01) |
| ***F04C 29/04*** | (2006.01) |
| ***F04C 29/12*** | (2006.01) |

(56) References Cited

U.S. PATENT DOCUMENTS

| | | | | |
|---|---|---|---|---|
| 5,228,414 | A * | 7/1993 | Crawford | F02B 55/08 123/18 A |
| 5,666,912 | A * | 9/1997 | McLachlan | F01C 9/002 123/193.6 |
| 5,979,163 | A | 11/1999 | Hanners et al. | |

FOREIGN PATENT DOCUMENTS

| | | | | |
|---|---|---|---|---|
| DE | 10 2008 040 574 | A1 | 1/2010 | |
| DE | 10 2010 036 977 | B3 | 11/2011 | |
| GB | 486 745 | A | 6/1938 | |
| GB | 486745 | A * | 6/1938 | F01C 9/002 |
| WO | 95/08055 | A1 | 3/1995 | |

OTHER PUBLICATIONS

International Search Report issued in PCT/EP2015/060500; dated Aug. 10, 2015.

Office Action issued in the related Chinese Patent Application No. 201580038189.6 dated Jul. 4, 2018; 16 pages.

* cited by examiner

PRIOR ART

PRIOR ART
Fig.11 A
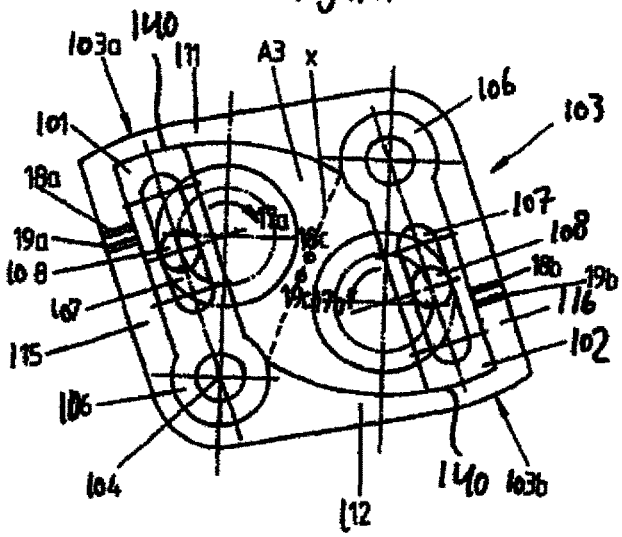
PRIOR ART
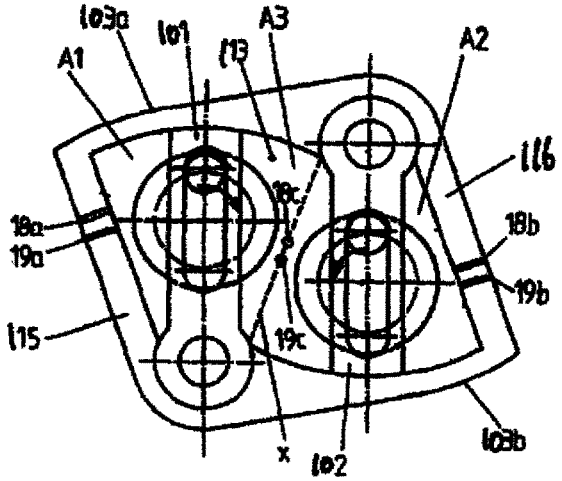
Fig. 11B

PISTON MACHINE WITH COOLING FUNCTION

The present invention relates to a piston machine which comprises a housing with a chamber which has a substantially circle sector-shaped cross-section, a pivotal piston which is designed as a pivoting element, is arranged in the housing, and comprises a first working surface, wherein the housing and the piston define at least one first variable working chamber; a drive or output which is connected to the piston; and an outlet which is arranged in the working chamber for discharging a working fluid.

Piston machines of the type as mentioned in the preamble, which are employed as working machines in the form of piston pumps and piston compressors or as power machines in the form of internal combustion engines, compressed gas motors or hydraulic motors for converting pressure generated in the working chamber into motion, are known from prior art.

For instance, DE 10 2008 040 574 A1 discloses a piston machine which has a piston being designed as a dual-pivot plate. The piston, which is arranged in a substantially circle sector-shaped housing, is pivotably mounted with the aid of a rotary cylinder formed thereon, and divides the housing into two separate working chambers which are each furnished with inlet and outlet valves.

DE 10 2010 036 977 B3 equally discloses a piston machine. The piston machine is equipped with two pistons which are designed as dual-pivot plates. A housing of the piston machine is formed from two or more integrally joined housing parts which are each circular cylindrical segment-shaped, but turned by 180 degrees, and form a common cavity, with pistons which are assigned to each housing part, are synchronically driven in respectively opposite directions and are arranged in parallel to one another, said pistons each defining an outer working chamber between the twin-piston plates with third and fourth inlet and outlet valves formed in a housing rear wall at the height of an imaginary separating line between the adjacent housing parts.

It is an object of the present invention to further develop a piston machine of the type as mentioned in the preamble so that it can be operated with greater efficiency. This object is attained by means of a piston machine being formed in accordance with the features of the main claim. Functional further developments of the application are the subject-matter of the subclaims and the exemplary embodiments.

The piston machine comprises a housing with a chamber which has a substantially circle sector-shaped cross-section, as well as a pivotal piston which is designed as a pivoting element, is arranged in the housing and comprises a first working surface, wherein the housing and the piston define at least one first variable working chamber. Furthermore, the piston machine comprises a drive or output, which is connected to the piston, and an outlet which is arranged in the working chamber for discharging a working fluid. The housing has a cooling opening in at least one housing wall, said opening leading to the chamber, at least for convectively cooling a piston side opposite the first working surface by means of a coolant. A coolant can be introduced into the chamber through the cooling opening, whereby temperature of the piston and/or the working fluid and/or the housing and/or the chamber can be reduced. In this way, efficiency of the piston machine can be increased. Typically, the cooling opening in fact reduces a work volume of the variable working chamber. However, the piston machine can only be operated by cooling with greater efficiency. Depending on the position of the cooling opening, besides the abovementioned surface of the piston, for instance further surfaces of the piston as well as one or more housing walls or parts of the chamber can be intensively cooled as well.

In one further development, the chamber is delimited by a wall which has a circular arc-shape in cross-section. In the following, said wall having a circular arc-shape in cross-section will be referred to as "circular arc-shaped wall". The cooling opening for instance can be provided in the circular arc-shaped wall. The opening in the circular arc-shaped wall makes it possible to flush the chamber by means of a coolant, whereby efficient cooling of the chamber can be realized. For instance, hot re-expansion gases can be removed from the chamber after compression in the chamber with the aid of a flushing process using the coolant. In this way, efficiency of the piston machine can be further enhanced.

A pivot angle (cf. e.g. angle $\alpha$ in FIGS. 1-6) of the piston can define the maximum deflection of a pivot movement of the piston from one dead center to the subsequent dead center. Preferably, the pivot angle is $\leq 90°$, typically $\leq 60°$. Preferably, the pivot angle is larger than 40°. Different pivot angles can be used as a function of the pressure ratios. Smaller pivot angles for instance of $\leq 10°$ can also be used, in particular for dosing pumps.

Typically, a center angle in a circle is indicated by the ratio of a circular arc with respect to the radius r of the associated circle. It can be provided that the opening in the circular arc-shaped wall is defined by a first center angle (cf. e.g. angle $\beta$ in FIG. 2), which is at most as large as the pivot angle ($\alpha$) of the piston. In one further development, the circular arc-shaped wall defines a second center angle (cf. e.g. angle $\gamma$ in FIG. 6) which, for instance, is at most as large as the pivot angle. Preferably, the second center angle is less than 50% of the pivot angle. A piston side facing the circular arc-shaped wall preferably is circular arc-shaped in cross-section and can define a third center angle (cf. e.g. angle $\delta$ in FIG. 10). The second center angle ($\gamma$) of the circular arc-shaped wall for instance is as large as the third center angle ($\delta$) of the piston side. The second center angle can also be smaller or larger than the third center angle. The first center angle ($\beta$) can be larger or smaller than or can be as large as the abovementioned second ($\gamma$) and/or third center angle ($\delta$). The dimensions of the abovementioned piston side, which is circular arc-shaped in cross-section, the circular arc-shaped wall and the opening in the circular arc-shaped wall thus can be varied and adjusted, depending on how much cooling is needed and on how large a feed or work volume of the piston machine is supposed to be.

Typically, the piston can be pivoted about a pivot axis. Here, the pivot axis can define an axial direction. A radial direction can be defined perpendicular to the axial direction and perpendicular to the pivot direction. For instance, it can be provided that the opening in the circular arc-shaped wall extends over an entire axial length of the circular arc-shaped wall.

In one embodiment, a pivot movement of the piston defines a pivot plane. Preferably, the chamber is delimited by a front wall and a rear wall, wherein the front wall and the rear wall can be formed in parallel to the pivot plane. It can be provided that the cooling opening is formed in the front wall and/or in the rear wall. This design makes it possible to attain cooling in a similar manner as with the abovementioned design of the cooling opening in the circular arc-shaped wall. The cooling opening in the rear wall and/or front wall for instance extends over an entire radial length of the rear wall and/or the front wall.

The drive or output typically comprises at least one crank shaft with a crank pin. The crank pin for instance engages into a connecting rod eye of a connecting rod being connected to the piston or into a guide groove of a connecting rod loop being firmly connected to the piston. It is known to the skilled person that there are many options available for constructing the drive or the output. A rotational speed of the crank shaft is typically more than 1500 $min^{-1}$. The rotational speed can even be up to 8000 $min^{-1}$ or more.

The working surface of the piston is typically the surface of the piston by means of which or on which work is performed. Moreover, it can be provided that the piston has a second working surface on a side opposite the first working surface, and the piston and the housing define a second variable working chamber with a second outlet valve arranged therein, wherein the cooling opening separates the cooling opening of the first working chamber from the second working chamber and is located at least on a separating line between the first working chamber and the second working chamber. Then, in each case work can be performed alternately by the first working surface and the second working surface, depending on which variable working chamber is closed or open at the moment. Convective cooling using the coolant then usually takes place at least at the respectively opposite side of the working surface of the piston. The cooling opening is preferably located in the circular arc-shaped wall, e.g. in the center of the arc-shaped wall, and/or in the front wall and/or in the rear wall. The two working chambers are alternately closed and opened typically during one complete pivot movement or turn of the crank shaft by 360°. The opened working chamber is flushed for instance by means of a coolant, while a working fluid can be fed or compressed in the closed working chamber. Thus, this design of the piston machine makes it possible to carry out the entire flushing and cooling process particularly efficiently.

In another embodiment, the working chamber is open or closed as a function of the pivot position of the piston. When the working chamber is open, the coolant preferably flows into the working chamber and at least convectively cools the piston side opposite the working surface and/or flushes the working chamber.

The chamber further can be delimited by a first side wall facing away from the first working surface, whereby the cooling opening is provided in the first side wall. Typically, the chamber is delimited by a second side wall facing the first working surface. Moreover, the variable working chamber can be delimited by the piston, the second side wall, the circular arc-shaped wall, the front wall and the rear wall. If the cooling opening is only provided in the first side wall facing away from the working surface, flushing of the working chamber using the coolant usually does not take place. Instead, this design enables continuous convective cooling of the piston side opposite the working surface.

The cooling opening in the first side wall can extend over an entire radial and/or axial length of the side wall. Preferably, the cooling opening extends even over the entire first side wall, i.e. the first side wall is omitted. In this way, it is possible to further enhance the cooling effect.

To form the cooling opening in the housing, one or several housing walls can be removed completely or partly, whereby work volume of the chamber in fact is reduced, but overall work quality of the piston machine can be improved.

It can be provided that the circular arc-shaped wall and/or the front wall and/or the rear wall and/or the abovementioned side wall are separated into two parts by the cooling opening. The cooling opening in particular can be provided in a housing wall, where space is available and good flow of the coolant is ensured. The cooling opening can be formed in the housing wall in various shapes, such as e.g. a groove, a circular sector or a circle or any other shape. It is also possible to provide several cooling openings in respectively different walls, e.g. in the circular arc-shaped wall and/or the front wall and/or the rear wall and/or the side wall. The abovementioned cooling openings can be combined with each other.

If several cooling openings are provided, one cooling opening can be designed as a coolant inlet and the other cooling opening can be designed as a coolant outlet. For instance, in one embodiment, a cooling opening is each formed in the rear wall and in the front wall. For instance, the coolant can be introduced into the chamber through the cooling opening of the rear wall or the front wall and can be discharged through the cooling opening of the front wall or the rear wall. Furthermore, the cooling opening can also be provided in the circular arc-shaped wall and in the rear wall and/or in the front wall. In this embodiment, for instance, the coolant can be introduced into the chamber through the cooling opening in the circular arc-shaped wall and can be discharged through the cooling opening in the rear wall and/or in the front wall. Other combinations of cooling openings in respectively different housing walls are also conceivable, in which the coolant is introduced into the chamber through a cooling opening and is discharged from the chamber through the respectively other cooling opening. In these embodiments, the chamber can be flushed particularly well by means of the coolant.

If several cooling openings are provided, they can have different sizes or can even be divided. The cooling openings can be differently designed in width and length.

The employed coolant or working fluid for instance can be air, $CO_2$ or other gases or can be a liquid, such as water. It is evident for the skilled person that the selection of the coolant and the working fluid depends on the respective design of the piston machine. The piston machine for instance can be operated as a pump, vacuum pump, compressor or engine/motor.

In another embodiment, a second wall, which is circular arc-shaped in cross-section, can be attached to the piston which is arranged on a smaller radius than a maximum radial length of the piston, and which engages into a passage of a side wall at least in a pivot position of the piston, wherein the cooling opening is preferably equally provided in this side wall. In one embodiment, the cooling opening forms the inlet for the second wall which is circular arc-shaped in cross-section. The cooling opening, which is provided in the side wall, can be provided above or below the second circular arc-shaped wall, viewed from the pivot axis. Preferably, the second circular arc-shaped wall is equally cooled by the coolant. Then, a second variable working chamber can be defined at least by the second arcuate wall, the piston and the side wall. With this embodiment, for instance, two-stage compression can be realized.

In another embodiment, an inlet valve is arranged in the working chamber at least for introducing the working fluid into the working chamber. Typically, the cooling opening differs from the inlet valve. In a preferred embodiment, the outlet is designed as an outlet valve. Typically, the cooling opening differs from the outlet valve. Thus, an inlet and outlet valve can be arranged in the working chamber, for instance in the rear wall, front wall, side wall and/or in the circular arc-shaped wall. Alternatively, the inlet valve can also be omitted. When the chamber is open, the chamber and/or the piston is/are at least convectively cooled and/or flushed by means of the coolant. As the pivot movement of the piston advances, the chamber subsequently closes. The coolant which still remains in the chamber then can be removed through the outlet valve.

In another embodiment, the piston features cooling fins for convective cooling. Preferably, the cooling fins are located on the piston side opposite the working surface. Furthermore, the piston can be designed as a cavity. The cooling fins and/or the cavity design make/makes it possible to further enhance cooling of the piston.

In another embodiment, a size of the cooling opening can be variably controlled or adjusted, preferably by means of a control member or slide or throttle valve being arranged in a housing wall. In this way, a size of the opening can be controlled or reduced or enlarged so as to influence or regulate cooling air flow rate. Hence, the piston machine can be adapted to various performance requirements, whereby the cooling effect can be controlled during operation. The variably controllable cooling opening can be opened or closed mechanically to a more or lesser degree as required, for instance via the motion of a camshaft. The variably controllable cooling opening can also be controlled by an electronic control device so as to change a size of the cooling opening as required during operation of the piston machine. In another embodiment, a pressure sensor and/or a temperature sensor is/are provided in the chamber and/or in the piston, which can be connected to the control device and/or an evaluation device. Upon reaching a threshold of a temperature and/or a pressure in the chamber and/or in the piston, the cooling opening can be opened or closed to a more or lesser degree and the size thereof can be enlarged or reduced, respectively. If the measured temperature for instance is less than a specific threshold, the cooling opening can be closed so as to increase a feed volume of the piston machine. Hence, it is possible to influence feed volume of the piston machine, coolant flow rate, pressure and temperature during operation of the piston machine using the variably controllable cooling opening so as to enhance efficiency of the piston machine.

The coolant can be drawn in through the cooling opening by means of the motion of the piston. Moreover, a cooling device, preferably a blower or a pump, can be provided for feeding the coolant through the opening of the housing and into the chamber. Cooling can be made even more efficient in this way. In order to further increase cooling air flow rate, a Venturi tube can be provided at the cooling opening, which makes it possible to considerably enhance flow rate.

It is evident for the skilled person that several chambers can be connected in succession or side-by-side. Hence, the housing for instance can have two or more joined housing parts, which are each circle sector-shaped, but turned by 180°, and form a common cavity, wherein a piston is assigned to each housing part. Then, two adjacent housing parts together with their pistons define at least one variable working chamber. Further details can be found for instance in document DE 10 2010 036 977 B3. Here, a cooling opening can be provided in at least one chamber. However, several or all chambers can have cooling openings as well.

A piston machine being designed as a compressor for instance enables compression to 10 bar or more, e.g. up to 20 bar, using one-stage compression. Moreover, the piston machine allows oil-free operation, which is desirable in particular for application as a vacuum pump, compressor or expansion motor.

Exemplary embodiments of the invention will be described in greater detail with reference to the attached drawings, wherein.

Figure 6A:
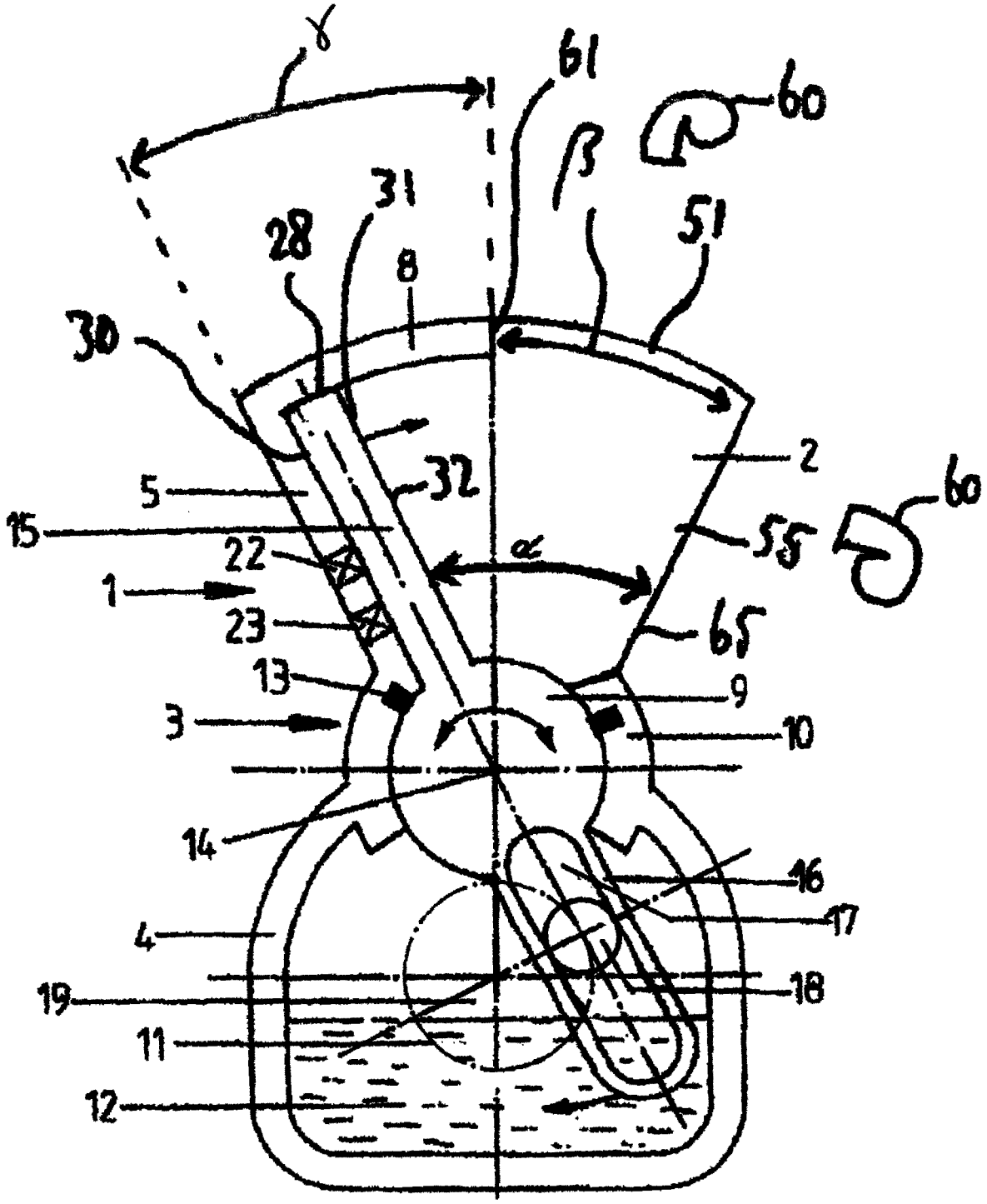
Figure 6B:
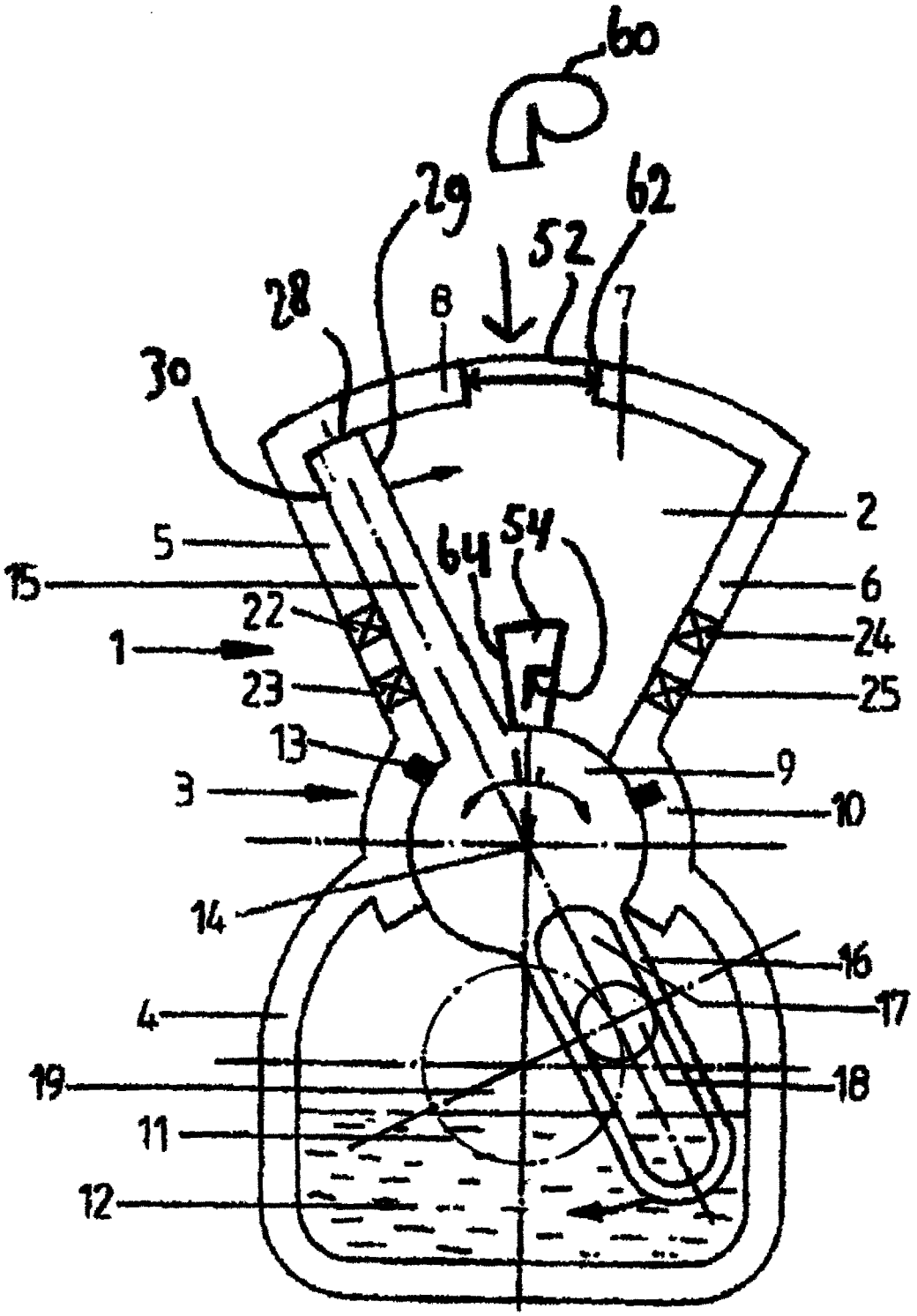
Figure 6C:
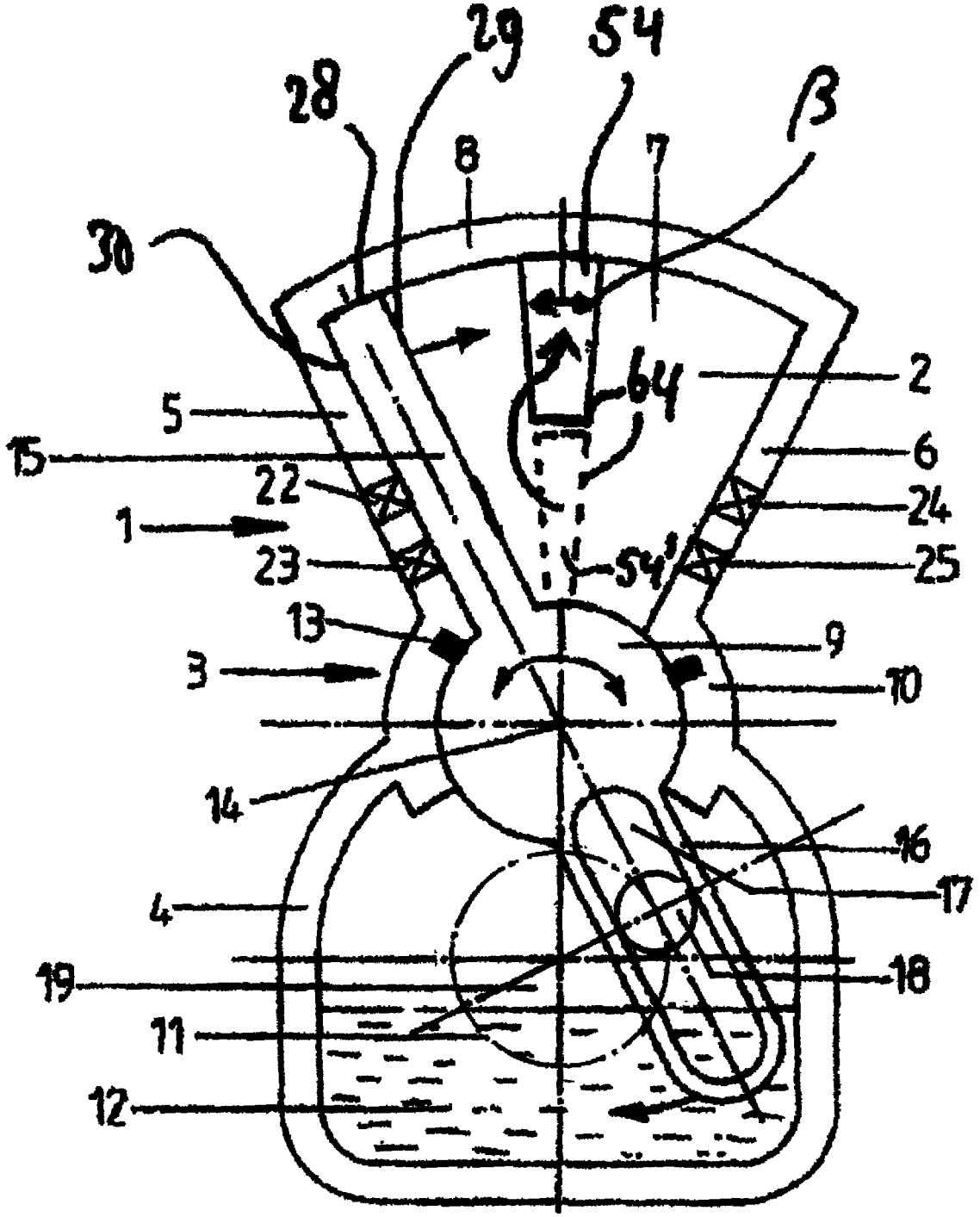
Figure 6D:
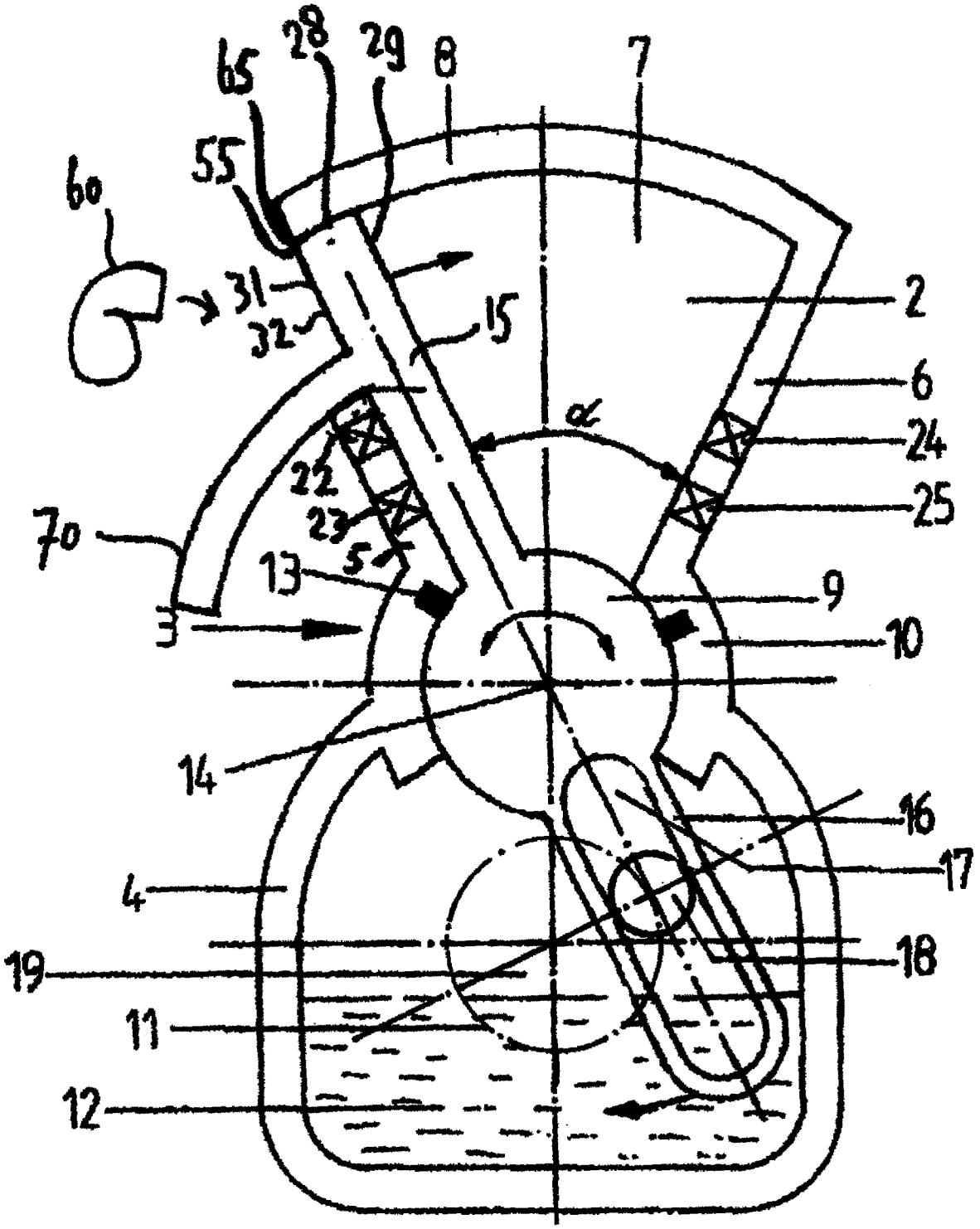
Figure 7A:
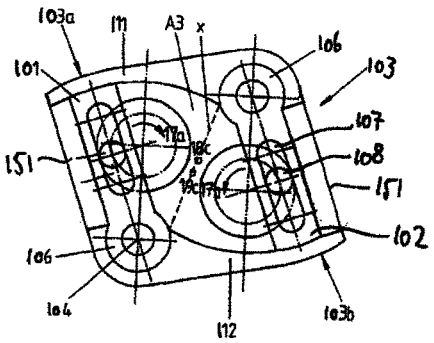
Figure 7B:
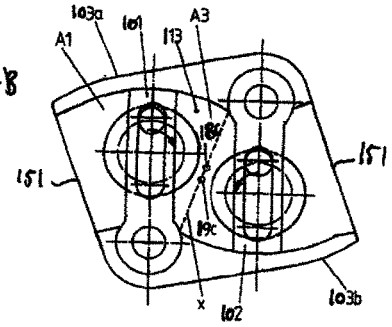
Figure 7C:
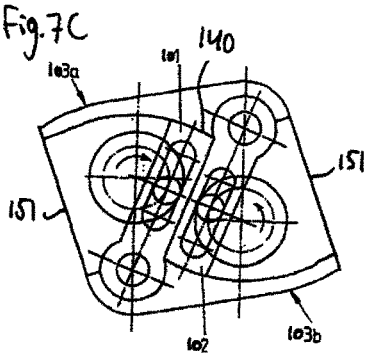
Figure 8C:
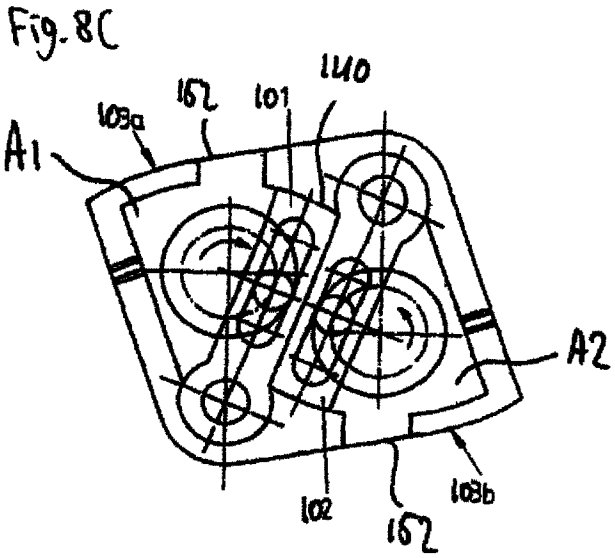
Figure 8A:
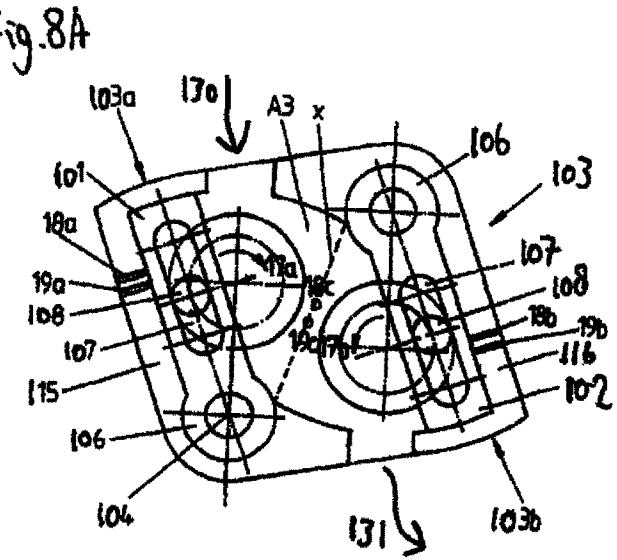
Figure 8B:
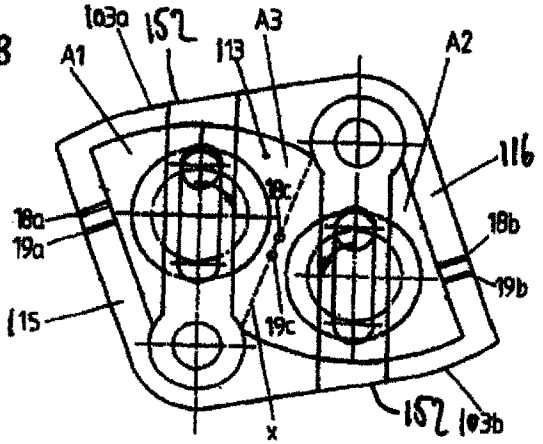
Figure 9A:
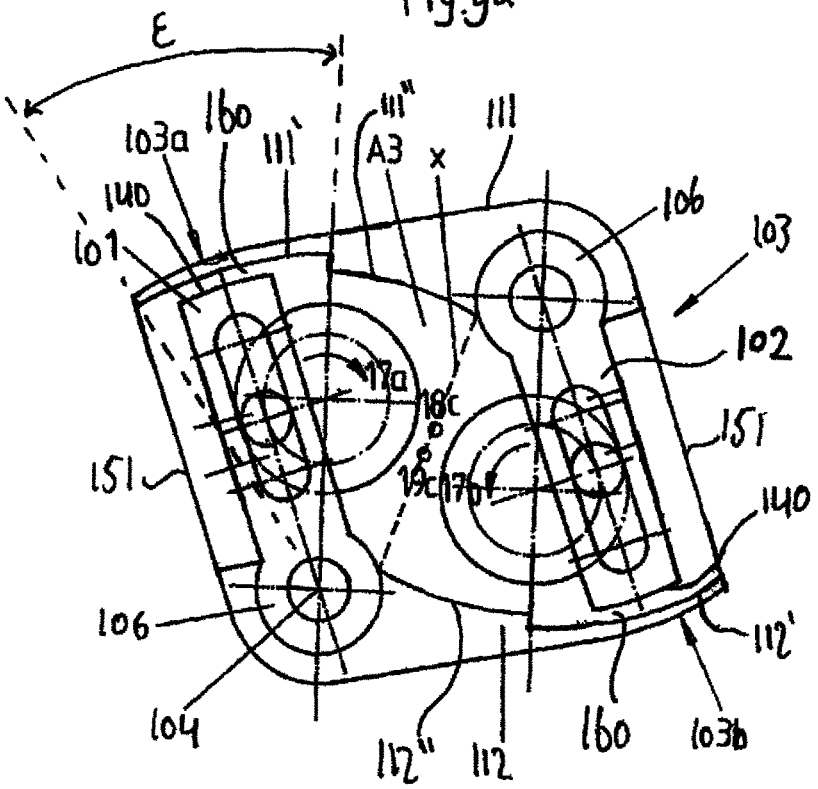
Figure 9B:
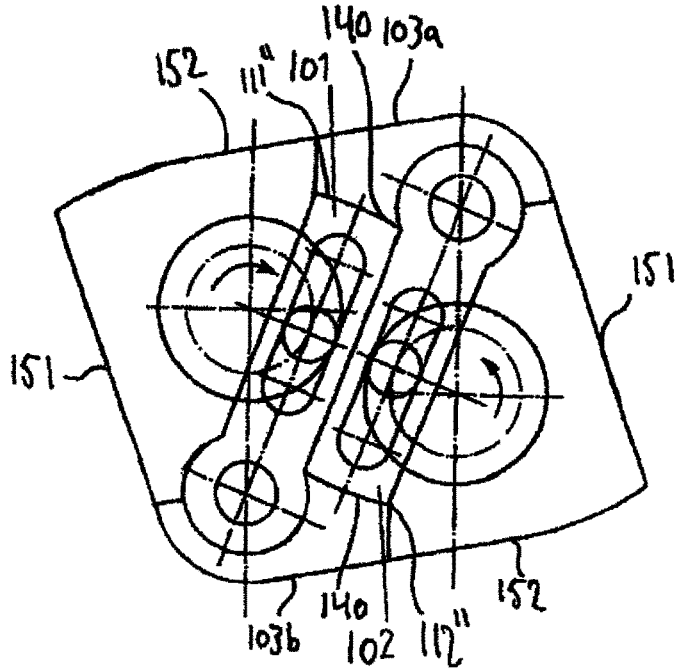
Figure 10:
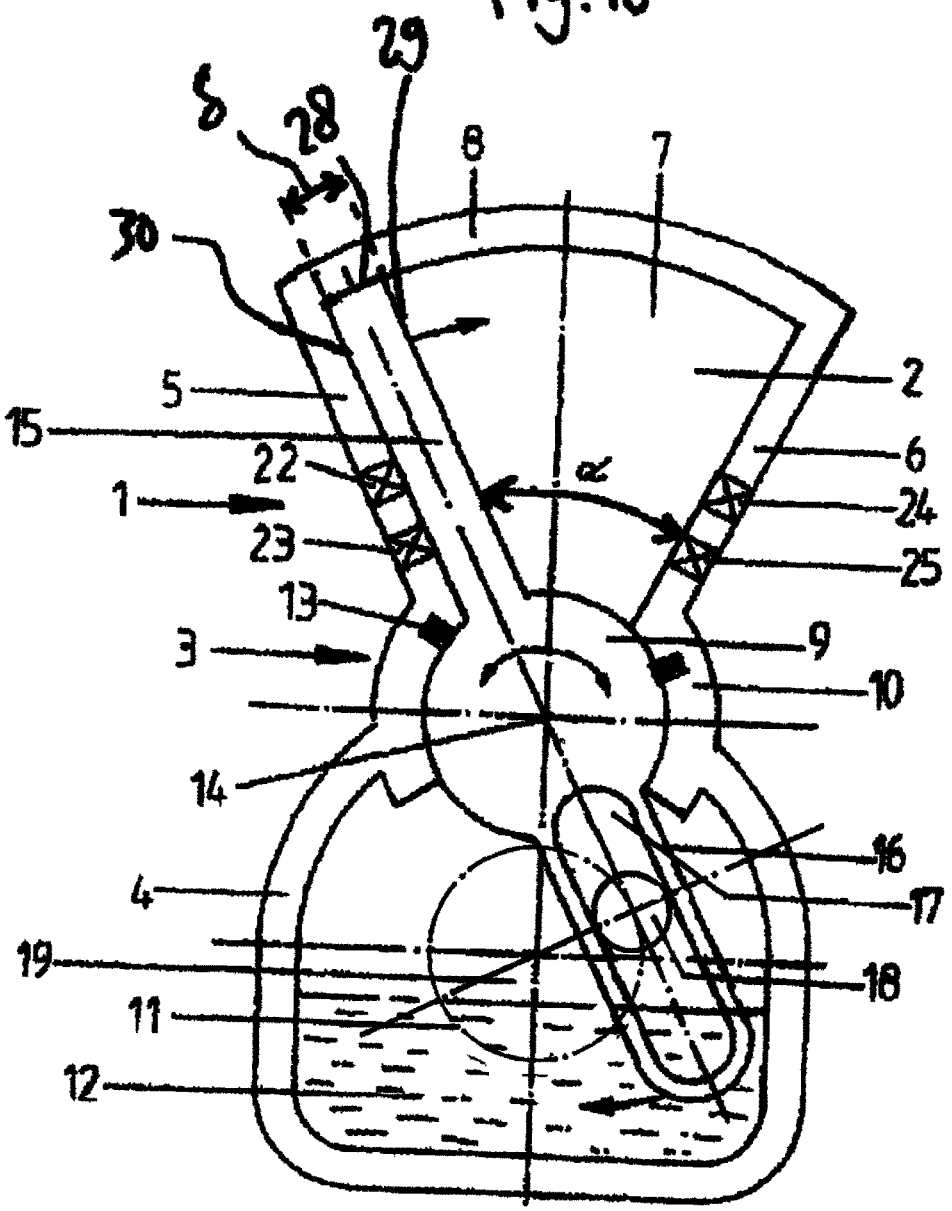
Figure 12:
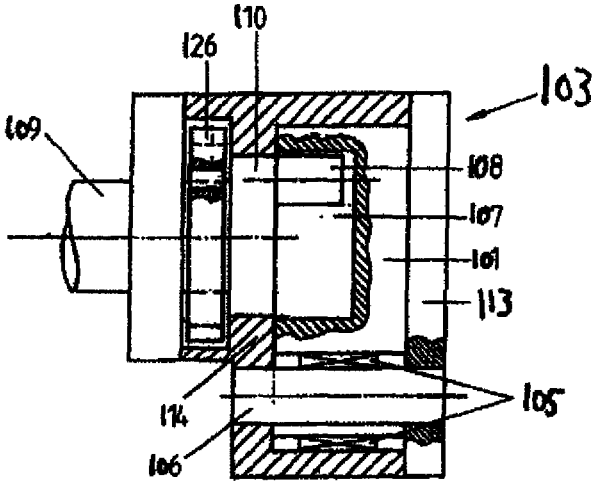
Fig. 12 PRIOR ART

FIGS. 6*a* to 6*c* show views of a cross-section of a piston machine with two cooling openings in different walls;

FIG. 6*d* shows a view of a cross-section of a piston machine with a second circular arc-shaped wall being attached to the piston;

FIGS. 7*a* to 7*c* show a view of a cross-section of a piston machine with two pistons being arranged in a common housing, wherein a cooling opening is each arranged in each side wall of the housing;

FIGS. 8*a* to 8*c* show a view of a cross-section of a piston machine with two pistons being arranged in a common housing, wherein an opening is each provided in each arc-shaped wall;

FIGS. 9*a* to 9*b* show a view of a cross-section of two piston machines with respectively two pistons being arranged in a common housing, wherein a cooling opening is each provided in each side wall and in each circular arc-shaped wall;

FIG. 10 shows a view of a cross-section of a piston machine according to prior art;

FIGS. 11*a* and 11*b* show a view of a cross-section of another piston machine according to prior art and FIG. 12 shows a side view of a cross-section of the piston machine according to FIG. 11, which is illustrated with a drive.

In the figures, recurring features are furnished with same reference numerals.

In the following, reference is firstly made to FIG. 10. FIG. 10 shows a piston machine according to prior art of DE 10 2008 040 574 A1, which forms part of the present application.

As illustrated in FIG. 10, the piston machine comprises a housing 1 which encloses a chamber 2, a bearing housing 3 and a crankcase 4. The chamber 2 has a circle sector-shaped cross-section and, according to the shape of a cylinder sector, is delimited by two side walls 5, 6, which are disposed at an angle $\alpha$ of approx. 53° with respect to each other, of a front end wall (not shown) and a rear end wall 7 well as a wall 8 which is circular arc-shaped in cross-section and a rotary cylinder 9. A bearing housing 3 formed by two opposite bearing shells adjoins the ends of the side walls 5, 6 opposite the circular arc-shaped wall 8. Moreover, provision is made for a crankcase 4 being partly filled with an oil sump 12. The rotary cylinder 9 being rotatable about a rotation axis 14 is mounted in the bearing housing 13. The chamber 3 is hermetically sealed towards the crankcase 4, for instance with sealing strips 13 being integrated in the bearing housing 3. A piston 15 being formed as a pivot plate and a connecting rod 16, which are disposed diagonally opposite to each other, are rigidly or integrally formed at the rotary cylinder 9. The connecting rod 16 has a guide groove 17 which extends over the entire length thereof and into which a crank pin 18 of a crank shaft 19, which is rotatably mounted in the crankcase 4, engages. The piston 15, which is typically designed as a cavity, is located in the working chamber 2 and with an upper edge 28 sealingly rests against an inner surface of the curved circular arc-shaped wall 8. The upper edge 28 of the piston 15 is circular arc-shaped in cross-section and is defined by a center angle δ of approx. 8°. Inlet valves 22, 24 and outlet valves 23, 25 are each formed in both side walls 5, 6 of the chamber 2. A pivot movement of the piston 15 defines a pivot plane, wherein the rear end wall 7 and the front end wall are parallel to the pivot plane. Of course, the abovementioned angles α and δ can also be larger or smaller than those shown in the example.

The above described piston machine can operate as a piston pump or piston compressor as follows, but can also function as an internal combustion engine, the function thereof being not described here, with inner or outer combustion: During rotary movement of a crank shaft 19, a crank pin 18 moving on a crank radius 11 slides in a guide groove 17 of a connecting rod 16 which thereby transmits a pivot movement to the piston 15. When a pivot movement of the piston 15 is performed from the position as shown in FIG. 10 at the left side wall 5 of the chamber 2 to the right side wall 6, the left inlet valve 22 and the right outlet valve 25 are open, while the left outlet valve 23 and the right inlet valve 24 are closed. Thus, a previously drawn in fluid is discharged from the chamber 2 via the right outlet valve 25. On the other side, a working fluid is drawn in via the left inlet valve 22, which is discharged again upon further rotary movement of the crank shaft 19 when the left inlet valve 22 is closed and the left outlet valve 23 is open, while on the right side fluid is drawn in via the inlet valve 24.

The piston 15 thus operates as a twin-piston with two working surfaces 29 and 30, which executes two pivot movements during one turn of the crank shaft 19, this means from the left dead center at the left side wall 5 to the right dead center at the right side wall 6 and back. The oil sump 12 effects lubrication of the crank mechanism, this means the guide groove 17 and the crank pin 18 sliding therein, which, incidentally, can also be formed with rolling bearings and sliding blocks.

As is known from DE 2008 040 574 A1, the guide groove 17 can also be arranged in the piston 15. Thus, a highly compact design can be realized.

Alternatively, it can also be provided that the crank pin 18 of the crank shaft 19 engages in a connecting rod eye of a connecting rod which is articulately connected to the piston. The drive and output of the piston machine thus is not limited to the illustrated embodiments.

Figure 1:
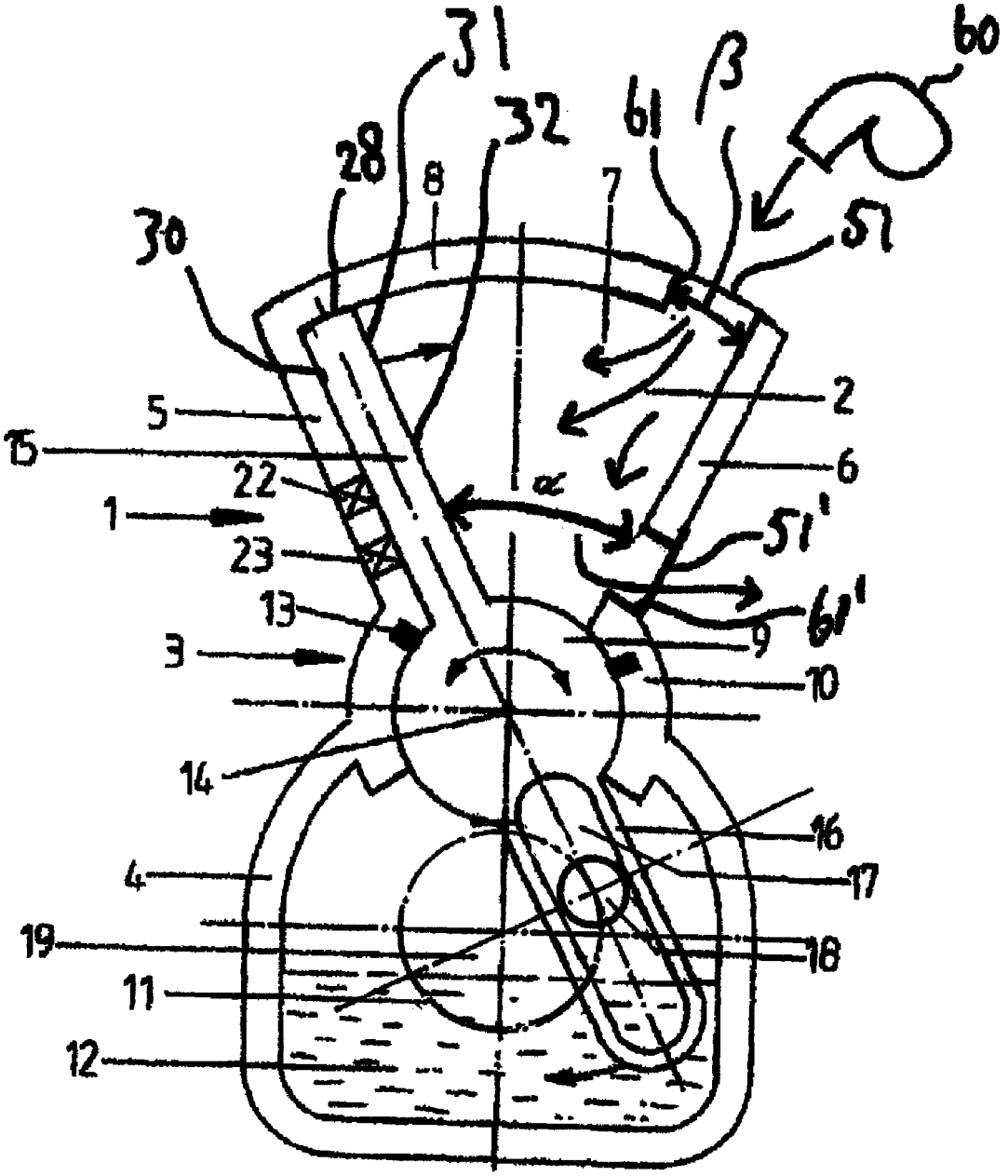
FIG. 1 shows a view of a cross-section of a piston machine with a cooling opening in a circular arc-shaped wall.
Figure 2:
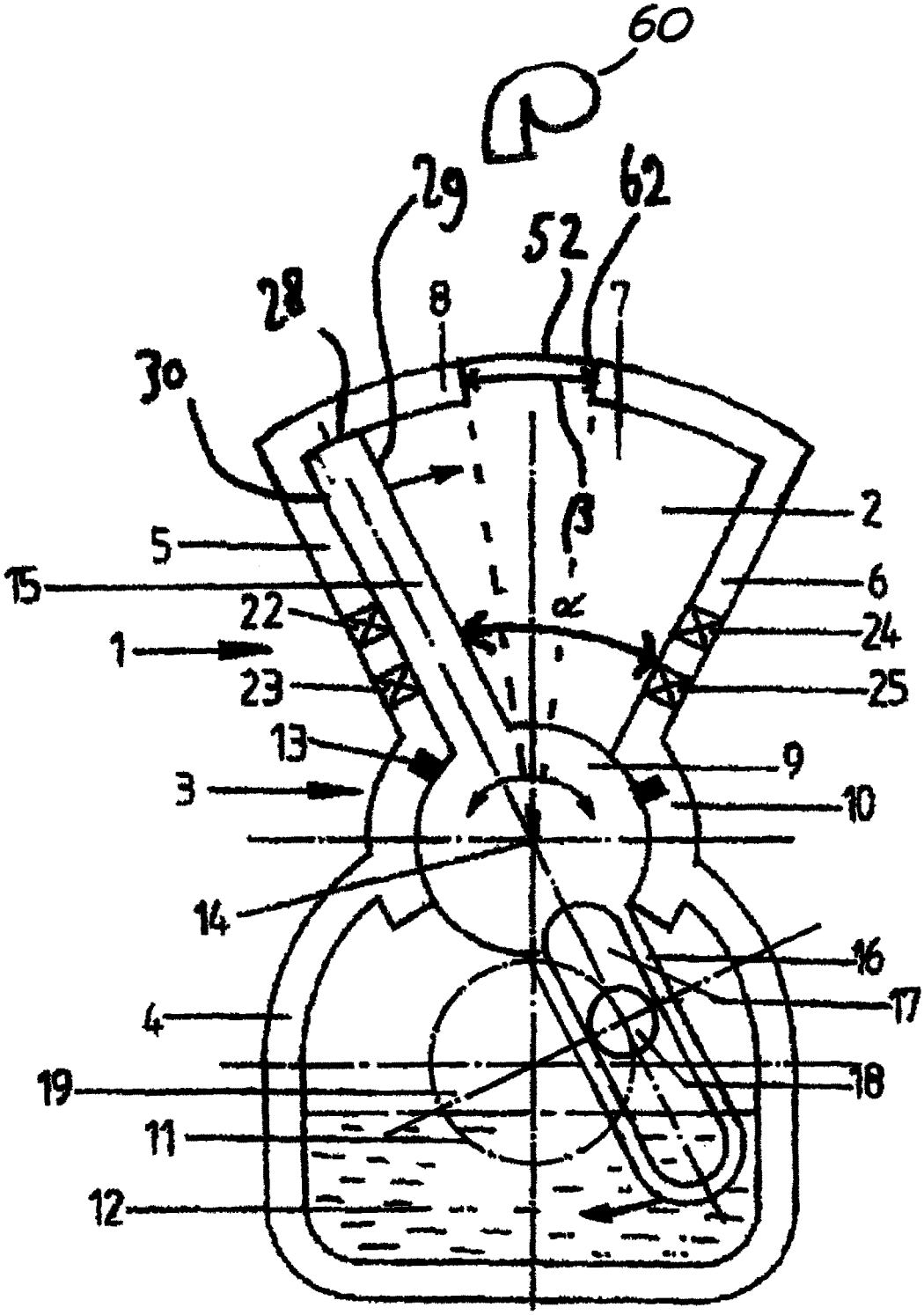
FIG. 2 shows a view of a cross-section of a piston machine with a cooling opening being located at the center of the circular arc-shaped wall.

FIG. 1 differs from FIG. 10 in that the housing 1 has a cooling opening 15 in the circular arc-shaped wall 8, said opening leading to the chamber 2. Moreover, in contrast to the embodiment of FIG. 10, inlet and outlet valves are not provided in the side wall 6. A coolant, in the illustrated example being air, flows through the cooling opening 51 into the chamber 2 and cools the same. Moreover, the piston 15 is convectively cooled by the air at least at a side 32 opposite the working surface 30. The piston machine of FIG. 1 for instance is designed as compressor and the cooling with the aid of the cooling opening makes it possible to increase efficiency of the compressor. Optionally, as shown in FIG. 1, provision can be made for a second cooling opening 51' in the side wall 6. Said second cooling opening for instance is designed as a coolant outlet through which the coolant can be discharged. In the figure, a flow direction of the coolant is indicated by arrows. This makes it possible to further enhance the flushing process and the cooling process. The piston machine of FIG. 2 differs from the exemplary embodiment of FIG. 10 in that a cooling opening 52 is provided at the center of the circular arc-shaped wall 8. While in the embodiment according to FIG. 1 two work cycles, namely drawing in and compressing, are possible during one turn of the crank shaft 10, in the embodiment according to FIG. 3, four work cycles are possible. The central formation of the cooling opening 52 makes it possible to alternately flush the working chamber 2 with coolant on the left and on the right-hand side. As a function of the pivot position of the piston 15, the working chamber 2 opens or the working chamber 2 closes. The cooling opening 52 in the circular arc-shaped wall 8 is defined both in FIG. 1 and in FIG. 2 by a center angle β which is smaller than a pivot angle α of the piston 15. In FIGS. 1 and 2 the opening 51 and 52 in the circular arc-shaped wall 8 extends over en entire axial length of the circular arc-shaped wall 8. This means the opening 51 and 52 is formed as an elongate groove in the circular arc-shaped wall and extends from the front end wall to rear end wall 7. Alternatively, the cooling opening 51 and 52 can have a smaller axial length.

Figure 3:
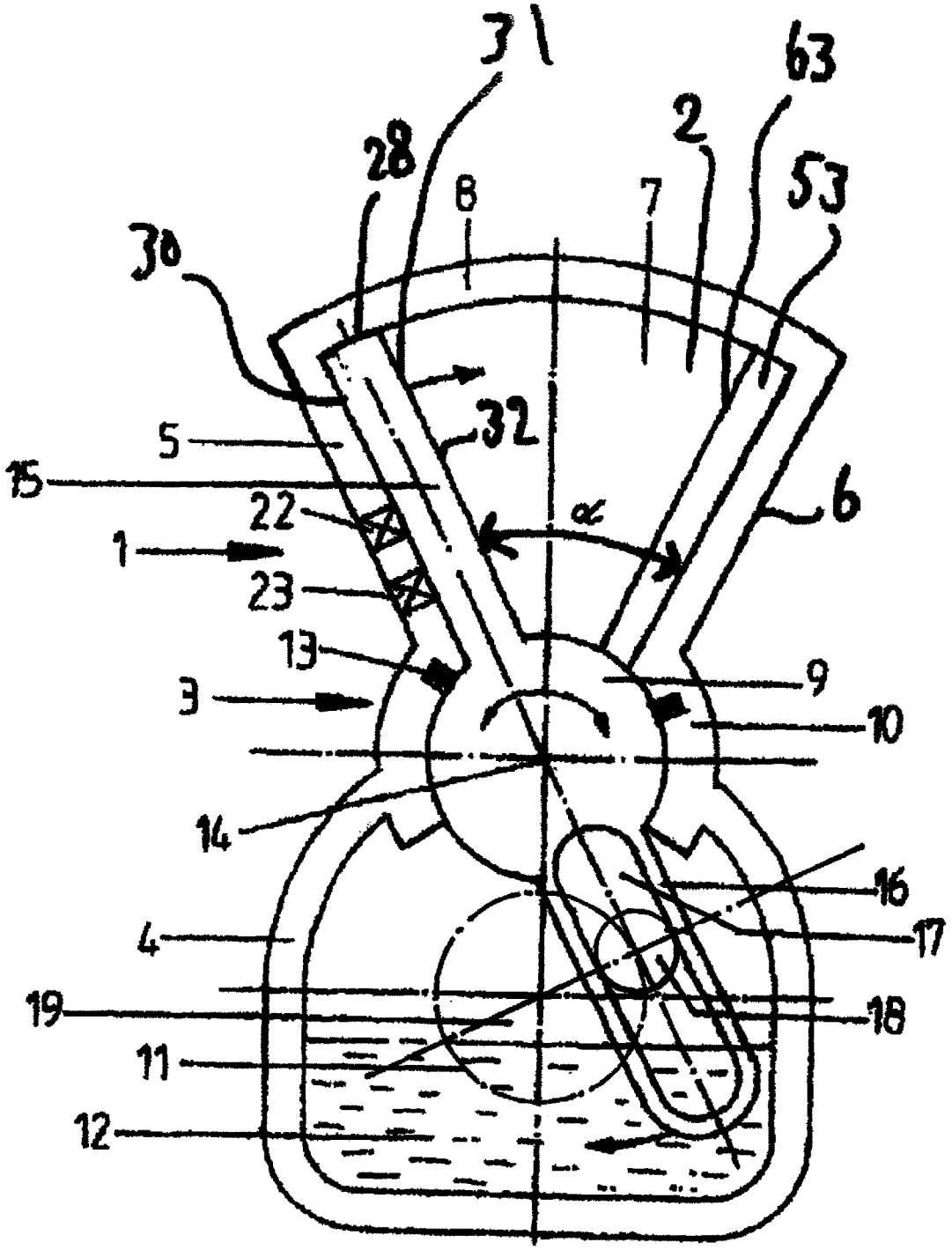
FIG. 3 shows a view of a cross-section of a piston machine with a cooling opening in a rear wall.

FIG. 3 differs from FIG. 10 in that a cooling opening 53 is arranged in the rear end wall 7. Moreover, in contrast to the embodiment of FIG. 10, inlet and outlet valves are not provided in the side wall 6. Moreover, the piston 15 has only one working surface 30.

The embodiment of FIG. 1 differs from the embodiment of FIG. 10 in that a cooling opening 54 is arranged at the center in the rear end wall 7. As is the case in FIG. 2, the opening 54 is also arranged at the center here. While the piston 15 closes the opening 53 of FIG. 3 at the right side wall 6 when the piston 15 is in a pivot position, the piston 15 closes the opening 54 when the piston is in a central position in FIG. 4. Both the opening 53 of FIG. 3 and the opening 54 of FIG. 4 extend over an entire radial length of the end wall 7 from the bearing housing 3 to the circular arc-shaped wall 8. In both embodiments, the opening 53 and 54 is also provided in the front end wall (not shown). Only one opening 53 and 54 can be provided in the front end wall or in the rear end wall 7.

Figure 4:
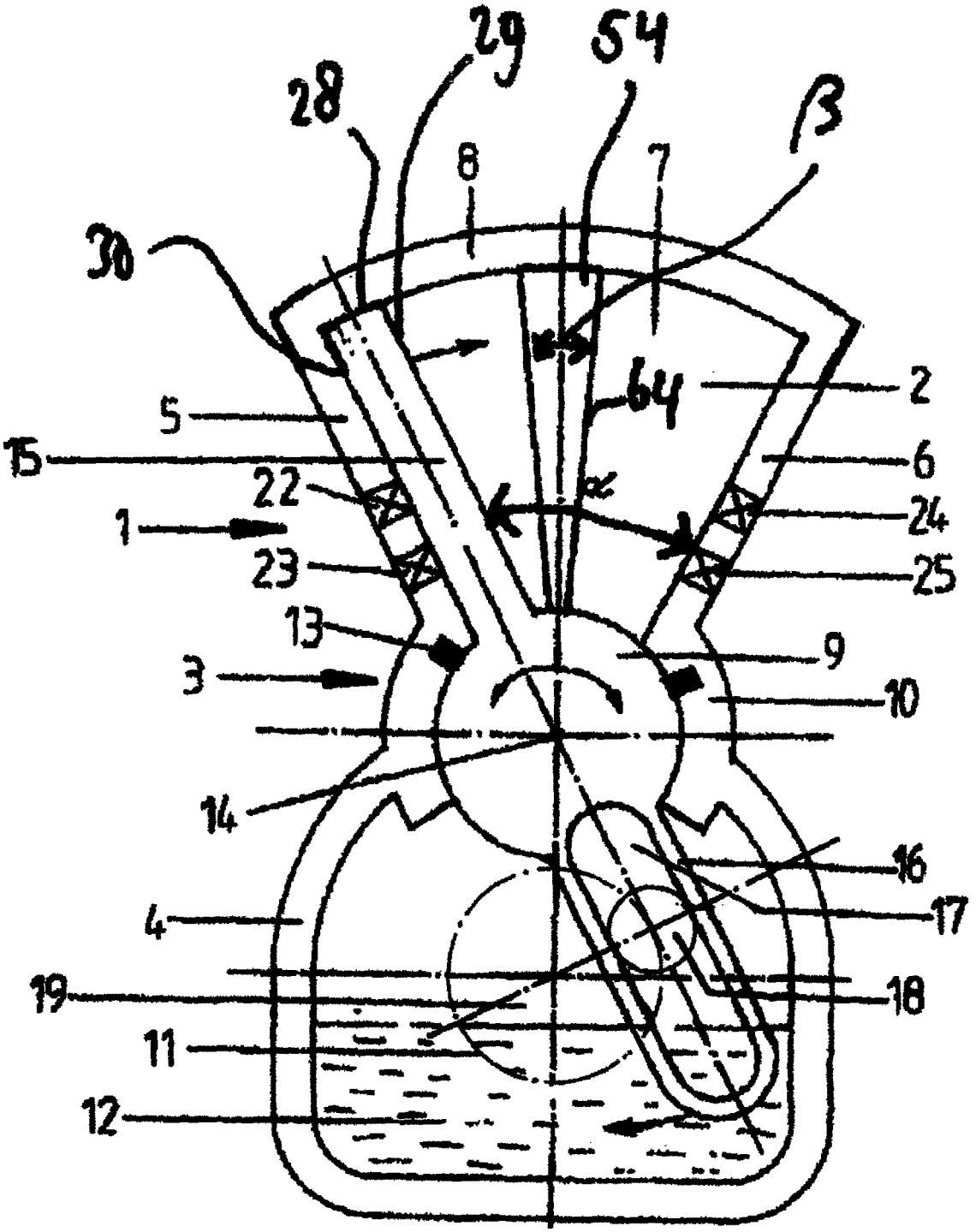
FIG. 4 shows a view of a cross-section of a piston machine with a cooling opening which is provided at the center in the rear wall.

While the piston 15 of FIGS. 1 and 3 has only one working surface 30, the piston 15 of FIGS. 2 and 4 has a second working surface 29 besides a first working surface 30. The cooling opening 52 and 54 of FIGS. 2 and 4 separates a first working chamber from a second working chamber. Moreover, the circular arc-shaped wall 8 of FIG. 2 and the end wall 7 of FIG. 4 are divided into two parts by the cooling opening 52 and the cooling opening 54, respectively.

Figure 5:
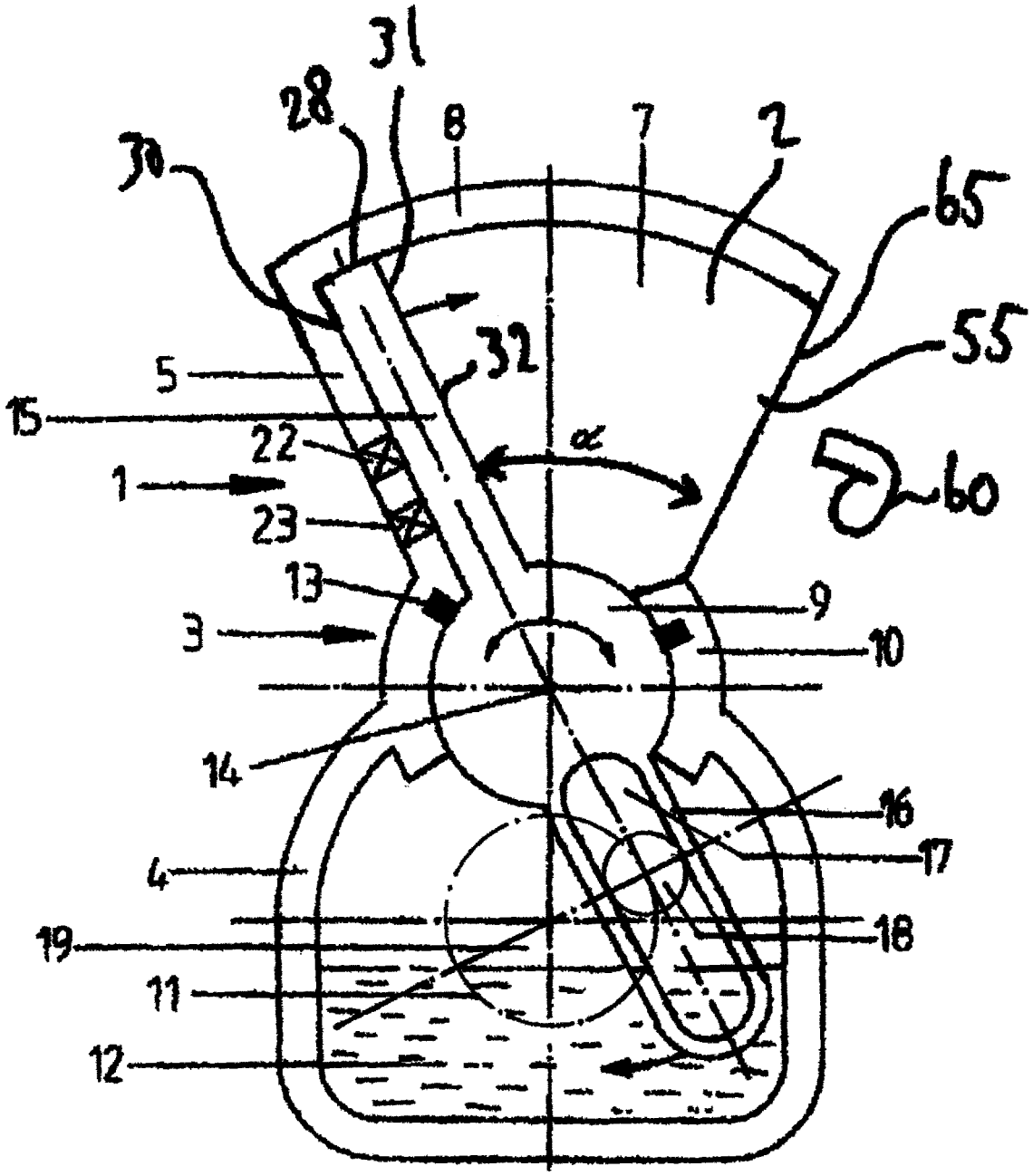
FIG. 5 shows a view of a cross-section of a piston machine with a cooling opening in a side wall.

The piston machine of FIG. 5 differs from the embodiment of FIG. 10 in that a cooling opening 55 is provided in the side wall 6. Moreover, in contrast to the embodiment of FIG. 10, inlet and outlet valves are not provided in the side wall 6. In this way, the piston 15 has only one working surface 30. The cooling opening 55 in the side wall 6 extends over an entire radial and axial length of the side wall 6, i.e. in the embodiment of FIG. 5 the entire side wall 6 has been omitted. Thus, continuous convective cooling of the piston 15 is possible at a side 32 opposite the working surface. In contrast to FIGS. 1 to 4, the variable working chamber of FIG. 5 is closed in every pivot position of the piston 15.

The embodiment of FIG. **6*a* differs from the embodiment of FIG. 10 in that the side wall 6 is completely omitted and that an opening 51 is further provided in the circular arc-shaped wall 8. Moreover, in contrast to the embodiment of FIG. 10, inlet and outlet valves are not provided in the side wall 6 and the piston 15 has only one working surface 30. The embodiment of FIG. 6*a* thus represents a mixture of FIGS. 5 and 1. The circular arc-shaped wall 8 of FIG. 6*a*** defines a second center angle γ of approx. 25', which is smaller than the above described pivot angle α of the piston 15. The opening 51 in the circular arc-shaped wall 8 is defined by the center angle β. In FIG. 6*a*, the angles β and γ are equal. However, in other embodiments they may also differ from one another. Hence, the center angle β can also be larger or smaller than the center angle γ.

In the embodiment of FIG. 6*b*, a cooling opening 52 and 54 is each provided in the circular arc-shaped wall 8 and in the rear end wall 7. The embodiment of FIG. 6*b* hence represents a mixture of the embodiments of FIGS. 2 and 4. In contrast to the embodiment of FIG. 4, the cooling opening 54 of the rear end wall 7, however, does not extend over an entire radial length of the end wall 7, but approximately up to one third of the radial length of the end wall 7. The coolant is introduced into the chamber 2 through the cooling opening 52, which is formed as coolant inlet, in the circular arc-shaped wall 8 using a blower 60. Subsequent to efficient flushing of the chamber 2, the coolant is then discharged from the chamber 2 through the cooling opening 54, which is formed as a coolant outlet, in the rear end wall 7. Here, the flow direction of the coolant is indicated by arrows. Thus, in this embodiment, the chamber 2 can be flushed particularly well by means of the coolant. In addition, a cooling opening can be provided in the front end wall (not shown).

In the embodiment of FIG. 6*c* provision is each made for a cooling opening 54 and 54' in the rear end wall 7 and in the front end wall. A projection of the cooling opening 54' of the front end wall to the rear end wall 7 is indicated by dashed lines in FIG. 6*c*. Similarly to the embodiment of FIG. 6*b*, coolant is introduced into the chamber 2 through the cooling opening 54, which is designed as a coolant inlet, in the front end wall using an optional blower (not shown). Subsequent to efficient flushing and cooling of the chamber 2, the coolant is then discharged from the chamber 2 through the cooling opening 54', which is designed as a coolant outlet, in the rear end wall 7. Here, the flow direction of the coolant is indicated by an arrow. Hence, in this embodiment, the chamber can be flushed particularly well by means of the coolant. Of course, the flow direction can also be reversed. In this case, the blower blows the coolant through the cooling opening 54 of the rear end wall into the chamber 2. The coolant exits the chamber 2 through the cooling opening 54' in the front end wall after flushing of the chamber 2.

As can be seen from FIGS. 1, 2, 4 and 6, the variable working chamber is closed or open as a function of the pivot position of the piston.

The piston machine of FIG. 6*d* differs from the embodiment of FIG. 10 in that a cooling opening 55 is provided in the side wall 5. Moreover, a second wall 70, which is circular arc-shaped in cross-section, is attached to the piston 15 and is arranged on a smaller radius than a maximum radial length of the piston 15, and engages in the cooling opening 55 of the side wall 5. In this way, continuous convective cooling of the second circular arc-shaped wall is effected. The cooling opening 55 which is equally formed as a passage for the second circular arc-shaped wall 70 is provided above the second circular arc-shaped wall 70, viewed from the pivot axis 14. As a matter of course, it can also be arranged below the second circular arc-shaped wall 70. A second variable working chamber is defined by the second circular arc-shaped wall 70, the piston 15, the side wall 5, the front wall and the rear wall 7 and is sealingly closed by said walls. Hence, in the embodiment of FIG. 6*d*, there are two variable working chambers which are closed in each pivot position of the piston 15, whereby for instance two-stage compression can be realized.

FIGS. 1-6*d* further differ from FIG. 10 in that a size of the cooling openings 51, 51', 52, 53, 54 and 55 can each be variably controlled or adjusted using a slide 61, 61', 62, 63, 64 and 65 being arranged in a respective housing wall. The slide 61, 61', 62, 63, 64 and 65 permits flush closure of the chamber 2 and in each case is connected to an electronic control device (not shown), which is further connected to a pressure sensor and temperature sensor (not shown) being arranged in the piston 15. The control device is adapted to control the slide 61, 61', 62, 63, 64 and 65 so as to control the size of the cooling opening 51, 51', 52, 53, 54 and 55 during operation of the piston machine and to enlarge or reduce it as required. At the time when a threshold of a temperature and/or pressure in the chamber 2 is reached, the cooling opening 51, 51', 52, 53, 54 and 55 can be opened or closed to cool the piston 15 and/or the chamber 2 or the size thereof can be enlarged or reduced. If the temperature measured at the piston 15 for instance is less or more than a specific threshold, the cooling opening 51, 51', 52, 53, 54 and 55 can be closed or opened so as to increase a feed volume of the piston machine. Thus, feed volume, coolant flow rate, pressure and temperature can be influenced during operation of the piston machine, so as to enhance efficiency of the piston machine. Alternatively, the slide 61, 61', 62, 63, 64 and 65 can be operated using a mechanical control device, for instance a camshaft, to open or close the cooling opening 51, 51', 52, 53, 54, 55 to a more or lesser degree. Instead of the slide 61, 61', 62, 63, 64 and 65 provision can also be made for a throttle valve or other control member.

Unlike the piston machine according to FIG. 10, in the embodiments of FIGS. 1, 3, 5, 6*a* and 6*d* cooling fins 31 are provided on a side 32 of the piston 15 opposite the working surface 30 to enhance cooling. Furthermore, in order to improve the cooling effect, in each of the embodiments of FIGS. 1-6 provision is made for an optional blower 60 or a cooling device (not shown in FIGS. 3, 4, 6*c*, 7, 8 and 9) which blows air or any other coolant into the cooling opening 51, 52, 53, 54 and 55 as required. The blower 60 is equally connected to the abovementioned control device. The blower 60 is controlled by the control device in particular if the slide 61, 62, 63, 64 and 65 opens or closes the respective opening 51, 52, 53, 54 and 55. If a cooling device is not provided, the coolant can be drawn in by the motion of the piston through the cooling opening 51, 52, 53, 54 and 55. In order to further increase the cooling air flow rate, provision can be made for a Venturi pipe in the cooling air inlet opening shown in the figures. In order to enhance the cooling effect, cooling fins can be provided on the outer surface of the housing.

Hereinafter, reference is made to FIGS. 11A, 11B and 12. In FIGS. 11A, 11B and 12 views of cross-sections of a piston machine according to prior art of DE 10 2010 036 977 B3 are shown, which equally forms part of the present application.

According to FIGS. 11A, 11B and 12, pistons 101 and 102 are connected to a rotary cylinder 106 which is rotatably mounted in a housing 103 about a rotation axis 104 via a bearing 105, and at an end side each have a guide groove 107 into which a crank pin 108 of a crank shaft 110 being connected to a driveshaft 109 engages. The guide groove 107 functions as a connecting rod loop or piston loop, which thus forms an integral part of the pistons 101 and 102. The two crank shafts 110 interacting with the respective piston 101 and 102, as shown in FIG. 12, are connected to each other via a gear mechanism 126 and are synchronized in such a manner that the pistons 101 and 102 can be driven in a respectively parallel opposite direction and can be moved in the housing parts 103*a* and 103*b* which are designed in the form of a cylinder sector (segment).

The integrally formed housing 103 comprises—indicated by a dashed line X—two joined housing parts 103*a*, 103*b* which, however, are turned by 180° and have a substantially circle sector-shaped cross-section, in which the rotary cylinders of the pistons 101 and 102 are once mounted at the upper housing wall 111 and once at the lower housing wall 112. A chamber A1 and A2 enclosed by the housing thus has the shape of two equisized circle sectors which lie side-by-side so as to be opposed to each other. The housing 103 further comprises a housing rear wall 114 and a housing cover 113 as well as a first side wall 115 and a second side wall 116. The two twin-pistons 101, 102, which are aligned in parallel to one another in every position, are disposed in an initial position, as shown in FIG. 11A, at the respective side wall 115, 116 and in the end position at the separating line X nearly abut against a defined gap. Inlet valves 18*a*, 18*b* and 18*c* as well as outlet valves 19*a*, 19*b* and 19*c* are arranged in the two side walls 115 and 116 and in the housing rear wall 114 at the height of the separating line X. By means of a synchronous but oppositely directed rotary movement of the two crank pins 108 according to arrow 17*a*, 17*b*, the two pistons 101 and 102 are moved towards one another close to the separating line X and are moved away from one another close to the side walls 115 and 116. Use can also be made of just one crank shaft, wherein the pistons 101 and 102 are synchronized for instance by a gearwheel. The piston machine according to FIG. 11 designed in this way can be operated for instance as a compressor, pump or engine/motor.

For instance, in case of the function as a pump, a feed medium, which is located in the inner large working chamber A3 between the two twin-piston plates 101 and 102 and which has been previously drawn in via the inlet valve 18*c*, is discharged from the working chamber A3 again during the pivot movement of the twin-piston plates 101 and 102 toward the separating line X. During this pivot movement (discharge), a feed medium is simultaneously drawn into the two outer (smaller) working chambers A1 and A2, which are each formed between the twin-piston plates 101 and 102 and the side walls 115 and 116, via the inlet valves 18*a* and 18*b*. When the two twin-piston plates 101 and 102 subsequently move in the direction of the side walls 115 and 116, the feed medium, which has been previously drawn into the working chambers A1 and A2, is discharged through the outlet valves 19*a*, 19*b* and at the same time, feed medium is drawn into the large working chamber A3 via the inlet valve 18*c*. In this way, efficient feed operation is ensured with the aid of two interacting twin-piston plates 101 and 102 and three working chambers A1, A2 and A3 in one and the same housing 103. The maximum volume of the two small outer working chambers A1 and A2 corresponds to the maximum volume of the larger inner working chamber A3. The above-described piston machine can be operated as a compressor or expansion motor or as a combination thereof with equally high efficiency. For instance, the medium-large—working chamber A3 can operate as an expansion motor, while the two outer smaller—working chambers A1 and A2 operate as compressor or pump and are driven by the expansion motor. When the described piston pump is used as a compressor, the inner working chamber A3 and an outer (left) working chamber A1 can be operated as a first compressor stage, and the other outer working chamber A2 can be operated as second compressor stage. Hence, the working chambers A1, A2 and A3 can each fulfil different functions as compressor, pump and engine/motor.

The embodiment of FIGS. 7A-7C differs from the embodiment of FIG. 11 in that cooling openings 151 are provided in the side walls 15 and 16, wherein the cooling openings 151 in the side walls 115 and 116 extend over an entire radial and axial length of the side walls 115 and 116. The cooling openings 151 make it possible to at least convectively cool the pistons 101 and 102 at a piston side opposite the working surface of the piston by means of a coolant. Besides, the embodiments of FIGS. 7*a* to 7*c* are similar to the embodiment of FIG. 5. Instead of two cooling openings 151, as can be seen in FIGS. 7*a-c*, a cooling opening 151 can also be provided in only one of the side walls 115 and 116. In this case, only one piston 101, 102 is cooled.

The embodiment of FIGS. 8A-8C differs from the embodiment of FIG. 11 in that two cooling openings 152 are provided in the circular arc-shaped wall. Just like in FIG. 11, the embodiment of FIG. 8 also comprises three working chambers A1, A2 and A3. A particularly good cooling effect can be attained in the working chamber A3, since the cooling openings 152 are arranged opposite one another. A coolant, for instance air, thus is allowed for instance to flow in and out from the one side to the other side, what is indicated in FIG. 8 using arrows 130 and 131. The cooling openings 152 thus make it possible to cool the working chambers A1, A2 and A3 and the pistons 101 and 102 at least convectively by means of a coolant. The cooling opening 152 here is designed as large as an upper edge 140 of the pistons 101 and 102. The cooling opening 152, however, can also be smaller or larger than the upper edge 140 of the pistons 101 and 102. As can be seen from FIG. 8*b*, there is a pivot position, in which all working chambers A1, A2 and A3 are closed. In the pivot position of FIG. 8*c*, the working chambers A1 and A2 are opened, while in the pivot position of FIG. 8*a*, the working chamber A3 is largely open. Besides, the arrangement of the cooling openings 152 in FIG. 8 is similar to the embodiment of FIG. 2. Alternatively, provision can also be made here for only one cooling opening 152 instead of two cooling openings 152.

In FIGS. 9*a* and 9*b* with respect to cooling openings 151 and 152 mixtures of FIGS. 7 and 8 are shown in analogy with the embodiment of FIG. 6*a*. In FIG. 9*a*, the wall, which is circular arc-shaped in cross-section, is formed by two parts 111' and 111" and 112' and 112, respectively, which are radially disposed at different positions. There is a radial gap 140 between the upper edge 140 of the piston and the circular arc-shaped housing wall 111' and 112'. Said radial gap 140 in the pivot direction extends over a center angle ε, and in axial direction extends from the housing cover 113 to the housing rear wall 114. The dimensions of the gap 140 can be varied depending on the embodiment in radial direction, in axial direction or in pivot direction. In FIG. 9*b*, the circular arc-shaped walls 111" and 112" are merely as large as the upper edge 140 of the piston 101 and 102. Alternatively, the dimensions of the circular arc-shaped wall 111" and 112" can be smaller or larger. In contrast to the embodiment of FIG. 8, in FIGS. 9*a* and 9*b* there is only one working chamber A3. In the embodiments of FIGS. 9*a* and 9*b*, the piston 101 and 102 can be convectively cooled from several sides. Hence, loss of chamber volume is compensated in FIGS. 9*a* and 9*b* by an increased cooling effect.

FIGS. 7-9 further differ from FIG. 11 in that a size of the cooling openings 151 and 152 can be variably controlled or adjusted using a slide (not shown) which is arranged in a corresponding housing wall. Said slide allows flush closure of the chamber and is in each case connected to an electronic control device (not shown) which is further connected to a pressure sensor end temperature sensor (not shown) which are arranged in the piston 101 and 102. The control device is adapted to control the slide so as to regulate or change the size of the cooling opening during operation of the piston machine. At the time when a threshold of a temperature and/or pressure is reached in the chamber, the cooling opening 151 and 152 can be opened or closed to a more or lesser degree to cool the piston 101 and 102 and/or the chamber. If the temperature measured at the piston 101 and 102 for instance is less or more than a specific threshold, the cooling opening 151 and 152 can be closed or opened to increase a feed volume of the piston machine. Hence, feed volume, coolant flow rate, pressure and temperature can be influenced during operation of the piston machine, to enhance efficiency of the piston machine. Alternatively, the slide can also be operated using a mechanical control device, for instance a camshaft, to open or close the cooling opening 151 and 152 to a more or lesser degree. Instead of the slide, for instance a throttle valve or other control member can also be provided.

Moreover, an optional blower or a cooling device is each provided in the embodiments of FIGS. 7-9 (not shown in FIGS. 7, 8 and 9), which draws air or other coolant into the cooling opening 151 and 152 as required, to improve the cooling effect. The blower is also connected to the above-mentioned control device. The blower is controlled by the control device in particular if the slide opens or closes the respective opening 151 and 152. If a cooling device is not provided, the coolant can be drawn in through the cooling opening 151 and 152 by the motion of the piston. In order to further enhance the cooling air flow rate, a Venturi pipe can be provided at the cooling air inlet opening which is shown in the figures. Cooling fins can be provided on the outer surface of the housing to increase the cooling effect.

The embodiments in FIGS. 7A to 9B can be broadened as desired by further housing parts, which are arranged side by side, but turned by 180° with respect to one another, and which have twin-piston plates.

The drive or output of the piston machine is not limited to the illustrated embodiments of FIGS. 1 to 9B. For instance, it can be provided that the crank pin of the crank shaft engages in a connecting rod eye of a connecting rod being articulately connected to the piston.

The features disclosed in the exemplary embodiments of the different embodiments can be combined and can be claimed individually.

List of reference numerals

| | | | |
|---|---|---|---|
| 1 | housing | 55 | cooling opening |
| 2 | working chamber | 60 | blower |
| 3 | bearing housing | 61 | slide |
| 4 | crankcase | 61' | slide |
| 5 | left side wall | 62 | slide |
| 6 | right side wall | 63 | slide |
| 7 | end wall | 64 | slide |
| 8 | circular arc-shaped wall | 65 | slide |
| 9 | rotary cylinder | 70 | circular arc-shaped wall |
| 10 | bearing shells | 101 | piston |
| 11 | crank radius | 102 | piston |
| 12 | oil sump | 103 | housing |
| 13 | sealing strips | 103a | housing part |
| 14 | pivot axis | 103b | housing part |
| 15 | piston | 104 | rotation axis |
| 16 | connecting rod | 105 | bearing |
| 17 | guide groove | 106 | rotary cylinder |
| 18 | crank pin | 107 | guide groove |
| 19 | crank shaft | 108 | crank pin |
| 22 | left inlet valve | 109 | drive shaft |

-continued

List of reference numerals

| | | | |
|---|---|---|---|
| 23 | left outlet valve | 110 | crank shaft |
| 24 | right inlet valve | 111 | housing wall |
| 25 | right outlet valve | 111' | circular arc-shaped wall |
| 28 | upper edge piston | 111" | circular arc-shaped wall |
| 29 | working surface | 112 | housing wall |
| 30 | working surface | 112' | circular arc-shaped wall |
| 31 | cooling fins | 112" | circular arc-shaped wall |
| 32 | piston side | 113 | housing cover |
| 51 | cooling opening | 114 | housing rear wall |
| 51' | cooling opening | 115 | first side wall |
| 52 | cooling opening | 116 | second side wall |
| 53 | cooling opening | 17a | motion crank pin |
| 54 | cooling opening | 17b | motion crank pin |
| 54' | cooling opening | 18a | inlet valve |
| | | 18b | inlet valve |
| 18c | inlet valve | 160 | gap |
| 19a | outlet valve | α | pivot angle of piston |
| 19b | outlet valve | β | center angle |
| 19c | outlet valve | γ | center angle |
| 130 | flow direction | δ | center angle |
| 131 | flow direction | ε | center angle |
| 140 | upper edge piston | A1 | working chamber |
| 151 | cooling opening | A2 | working chamber |
| 152 | cooling opening | A3 | working chamber |

The invention claimed is:

1. Piston machine, comprising:

a housing with a chamber which has a substantially circle sector-shaped cross-section, a pivotal piston which is designed as a pivoting element, is arranged in the housing and includes a first working surface, the housing and the piston define at least one first variable working chamber, a drive or output connected to the piston, an outlet arranged in the working chamber for discharging a working fluid, the housing having two or more joined housing parts, which are each circle sector-shaped, but turned by 180°, and form a common cavity, wherein one said pivotal piston being assigned to each housing part, and two adjacent housing parts together with their pistons define a common variable working chamber, the housing having a cooling opening in at least one housing wall, said opening leading to the chamber at least for convectively cooling a side of the piston opposite the first working surface by a coolant.

2. Piston machine according to claim 1, wherein the chamber is delimited by a wall, which is circular arc-shaped in cross-section, and the cooling opening is provided in the circular arc-shaped wall.

3. Piston machine according to claim 2, wherein the opening in the circular arc-shaped wall is defined by a center angle which is at most as large as a pivot angle of the piston.

4. Piston machine according to claim 2, wherein the circular arc-shaped wall defines a second center angle, wherein a piston side facing the circular arc-shaped wall is circular arc-shaped in cross-section and defines a third center angle, wherein the second center angle is as large as the third center angle or smaller or larger than the third center angle.

5. Piston machine according to claim 2, wherein the opening in the circular arc-shaped wall extends over an entire axial length of the circular arc-shaped wall.

6. Piston machine according to claim 2, wherein the piston has a second working surface on a side opposite the first working surface, and the piston and the housing define a second variable working chamber with a second outlet valve arranged therein, wherein the cooling opening separates the first working chamber from the second working chamber.

7. Piston machine according to claim 2, wherein the circular arc-shaped wall and/or the front wall and/or the rear wall and/or the side wall are divided into two parts by the cooling opening.

8. Piston machine according to claim 1, wherein a pivot movement of the piston defines a pivot plane and the chamber is delimited by a front wall and a rear wall, wherein the front wall and the rear wall are parallel to the pivot plane, and the cooling opening is provided in the front wall and/or in the rear wall.

9. Piston machine according to claim 8, wherein the opening in the rear wall and/or front wall extends over an entire radial length of the rear wall and/or front wall.

10. Piston machine according to claim 1, wherein the working chamber is open or closed as a function of the pivot position of the piston.

11. Piston machine according to claim 1, wherein the chamber is delimited by a side wall facing away from the first working surface, wherein the cooling opening is provided in the side wall.

12. Piston machine according to claim 11, wherein the cooling opening in the side wall extends over an entire radial and/or axial length of the side wall.

13. Piston machine according to claim 1, further comprising a second wall, which is circular arc-shaped in cross section, is attached to the piston, is arranged on a radius smaller than a maximum radial length of the piston and in at least one pivot position of the piston engages into a passage of a side wall, wherein a second variable working chamber is defined at least by the second circular arc-shaped wall, the piston and the side wall.

14. Piston machine according to claim 1, wherein the piston has cooling fins and/or is designed as a cavity.

15. Piston machine according to claim 1, further comprising a cooling device is provided for feeding the coolant through the opening of the housing and into the chamber.

16. Piston machine according to claim 1, wherein a size of the cooling opening is variably controlled or adjusted, by a control member or slide or throttle valve, which is arranged in a housing wall.

17. Piston machine, comprising:

a housing with a chamber which has a substantially circle sector-shaped cross-section, a pivotal piston which is designed as a pivoting element, is arranged in the housing and includes a first working surface, the housing and the piston define at least one first variable working chamber, a drive or output which is connected to the piston, an outlet which is arranged in the working chamber for discharging a working fluid, the housing having a cooling opening in at least one housing wall, said opening leading to the chamber at least for convectively cooling a side of the piston opposite the first working surface by a coolant, and a second housing wall, which is circular arc-shaped in cross section, being attached to the piston, being arranged on a radius smaller than a maximum radial length of the piston and in at least one pivot position of the piston engaging into a passage of a side wall, and a second variable working chamber being defined at least by the second housing wall, the piston, and the at least one housing wall.

18. Piston machine, comprising:

a housing with a chamber which has a substantially circle sector-shaped cross-section, a pivotal piston which is designed as a pivoting element, is arranged in the housing and includes a first working surface, the housing and the piston define at least one first variable working chamber, a drive or output which is connected to the piston, an outlet which is arranged in the working chamber for discharging a working fluid, the housing having a cooling opening in at least one housing wall, said opening leading to the chamber at least for convectively cooling a side of the piston opposite the first working surface by a coolant, a size of the cooling opening being variably controlled or adjusted, by a control member or slide or throttle valve, which is arranged in said at least one housing wall.

* * * * *